United States Patent [19]

Bearce

[11] 3,982,052

[45] Sept. 21, 1976

[54] METHOD OF TREATING WET COAL GRANULES

[76] Inventor: Wendell E. Bearce, Box 241, St. Clairsville, Ohio 43950

[22] Filed: Jan. 27, 1975

[21] Appl. No.: 544,107

[52] U.S. Cl. ..... 427/212; 34/48; 44/6; 118/59; 118/418; 427/242; 427/384

[51] Int. Cl.[2] ..... C10L 5/04; C10L 5/24

[58] Field of Search ..... 427/242, 212, 220, 221, 427/215; 44/6, 26; 118/59, 418

[56] References Cited

UNITED STATES PATENTS

| | | | |
|---|---|---|---|
| 2,083,756 | 6/1937 | Vissac | 44/6 X |
| 2,238,776 | 4/1941 | Kleinicke | 44/6 |
| 2,479,561 | 8/1949 | Elkan | 44/6 |
| 3,730,692 | 5/1973 | Holowaty et al | 44/6 |

FOREIGN PATENTS OR APPLICATIONS

| | | | |
|---|---|---|---|
| 24,809 | 10/1935 | Australia | 427/220 |

*Primary Examiner*—Ralph Husack
*Attorney, Agent, or Firm*—William J. Ruano

[57] ABSTRACT

A method and apparatus for drying wet coal granules or particles by introducing a liquid petroleum or coal derivative into the wet granular material, either before feeding into a dryer, or while it is fed, or at some point along the dryer cylinder embodying my prior patent 3,401,923. Thus the danger of explosion or obnoxious dust resulting from dry coal is eliminated and the calorific value of the coal is greatly increased. A modification of the air lock shown in my prior U.S. Pat. No. 3,401,923 is also made for improving the passage of heated particles into the housing.

6 Claims, 6 Drawing Figures

METHOD OF TREATING WET COAL GRANULES

This invention relates to a method of drying and impregnating granules of coal for drying and increasing the heating value of the coal particles, and is an improvement of the invention covered by my prior U.S. Pat. No. 3,401,923, issued Sept. 17, 1968.

In accordance with my prior patent, a novel dryer is provided for wet granular materials, such as coal, to effect thorough drying of the particles.

However, an outstanding disadvantage of the dry coal particles obtained thereby, if completely dried, is that dust results in further handling which is objectionable from a health, safety or convenience standpoint,- in some case resulting in an explosion.

If enough moisture is left in the coal by suitable controls in an attempt to overcome this danger, the additional moisture or water reduces the concentration of combustible coal and increases handling charges, such as freight costs, because of the greater weight per unit of material, especially for very fine coal where perhaps about 7 to 9 percent moisture, by weight, is required to overcome dustiness. This reduces the heating value per ton, both because the water is inert and because an appreciable percentage of the heating value of fuel is required to evaporate it prior to or during combustion at its ultimate destination.

An object of the present invention is to overcome all the abovementioned disadvantages of my prior patented apparatus and method of drying coal so as to greatly increase the heating value of the coal and, at the same time, eliminate the dangers resulting from the drying process.

A more specific object of my invention is to provide a novel method of simultaneously drying and impregnating coal particles with petroleum or other coal derivatives so as to eliminate dustiness even if the coal is thoroughly dry of water, and, at the same time, substantially increasing the heating or B.T.U. value of the coal particles because of their impregnation with oil.

A still further object of my invention is to provide an improvement in the air lock shown in FIG. 4 of my prior patent by the provision of two cam operated pivoted gates for controlling the flow of heated particles in the lifting chamber (FIG. 6 herein).

Other objects and advantages will become more apparent from a study of the following description taken with the accompanying drawings wherein.

Figure 1:
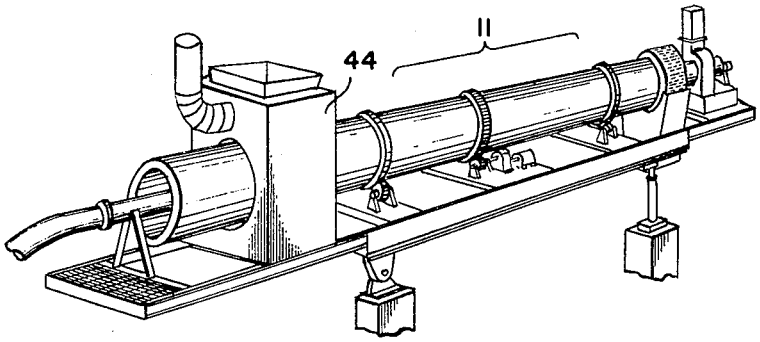
FIG. 1 is a view in perspective of a dryer constructed in accordance with this invention.
Figure 3:
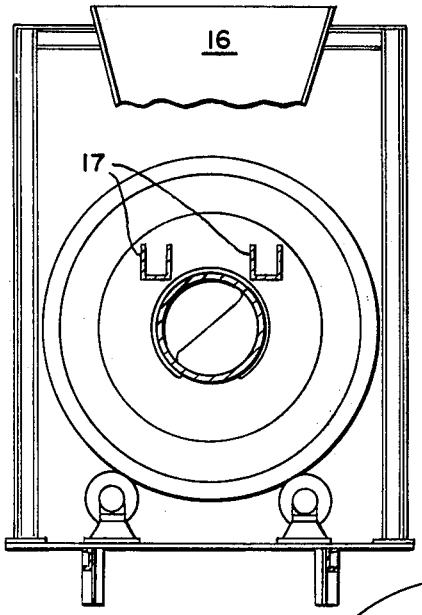
FIG. 3 is a view in section taken as indicated by the lines and arrows 3—3 which appear in FIG. 2.

There is shown in FIGS. 1–4 a dryer 11 for drying wet granular material 12. The dryer includes a rotatable container or cylinder 13 having a feed end 14 and a discharge end 15. A feed hopper 16 and vibrating feed chutes 17 are provided for feeding the wet granular material 12 to feed end 14.

A housing 18, having a feed end 21 and a discharge end 22, is adapted to introduce heated particles 23 into wet granular material 12 to transfer heat to and dry the granulated material while in cylinder 13. Housing 18 feeds particles 23 to feed end 14 of cylinder 13. The particles 23 may be of any shape, for example, they may be balls of steel or of other heat conducting material.

The particles 23 are heated in housing 18. The heating means includes a firing chamber 24 lined with refractory brick 25, and a burner 26 which generates hot gases 27 and directs them through housing 18 to heat the particles therein.

Particles 23 are recycled through cylinder 13. The recycling means includes a lifting chamber 28 at the exit end of cylinder 13 for receiving the particles 23 which have transferred their heat to the granular material and are now cool, and lifters 31 mounted in chamber 28 for elevating the particles to feed end 21 of housing 18.

A suitable material, such as a petroleum or coal derivative (which is not volatile at 212°F, the boiling point of water), is introduced into the wet granular material 12, either prior to feeding, as it is fed to or at some point along the length of the dryer cylinder 13. This material, rendered miscible by contact with the heated particles 23, is thoroughly applied to the individual particles of the wet granular material 12 by the tumbling, mixing action of the heated particles 23. The temperature and retention time is controlled so that all of the moisture is evaporated from the wet granular material 12 and replaced by the liquified oil-like material. With the very thorough mixing provided by the tumbling, rolling action of the heated particles 23 in the rotating drum 13, a relatively small quantity of oil-like material suffices to prevent dustiness. Thus the material being dried is discharged at maximum practical concentration, free from dust, and in the case of a fuel, such as coal, with a heating value greater than the coal itself, were it completely dry.

Air locks 32 limit the amount of air that is sucked into housing 18 from lifting chamber 28, and comprise a number of panels which revolve around an axis in the manner of a revolving door.

Figure 4:
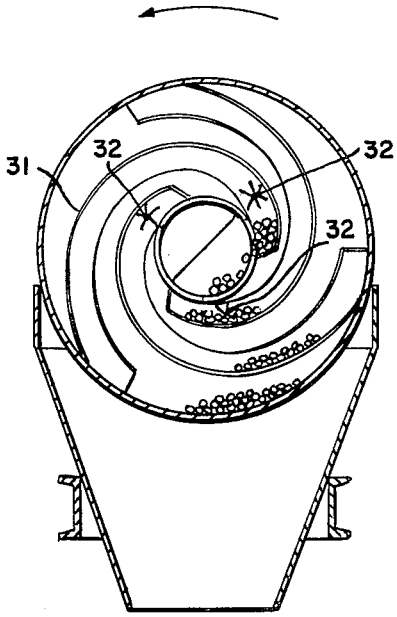
FIG. 4 is a view in section taken as indicated by the lines and arrows 4—4 which appear in FIG. 2.
Figure 6:
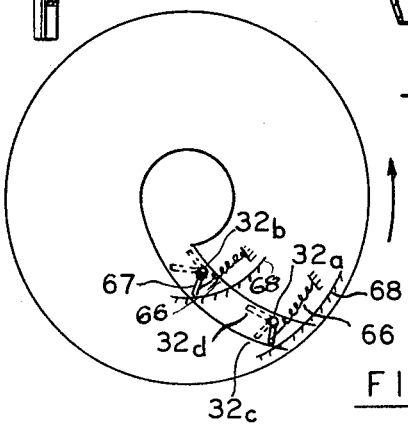
Figure 2:
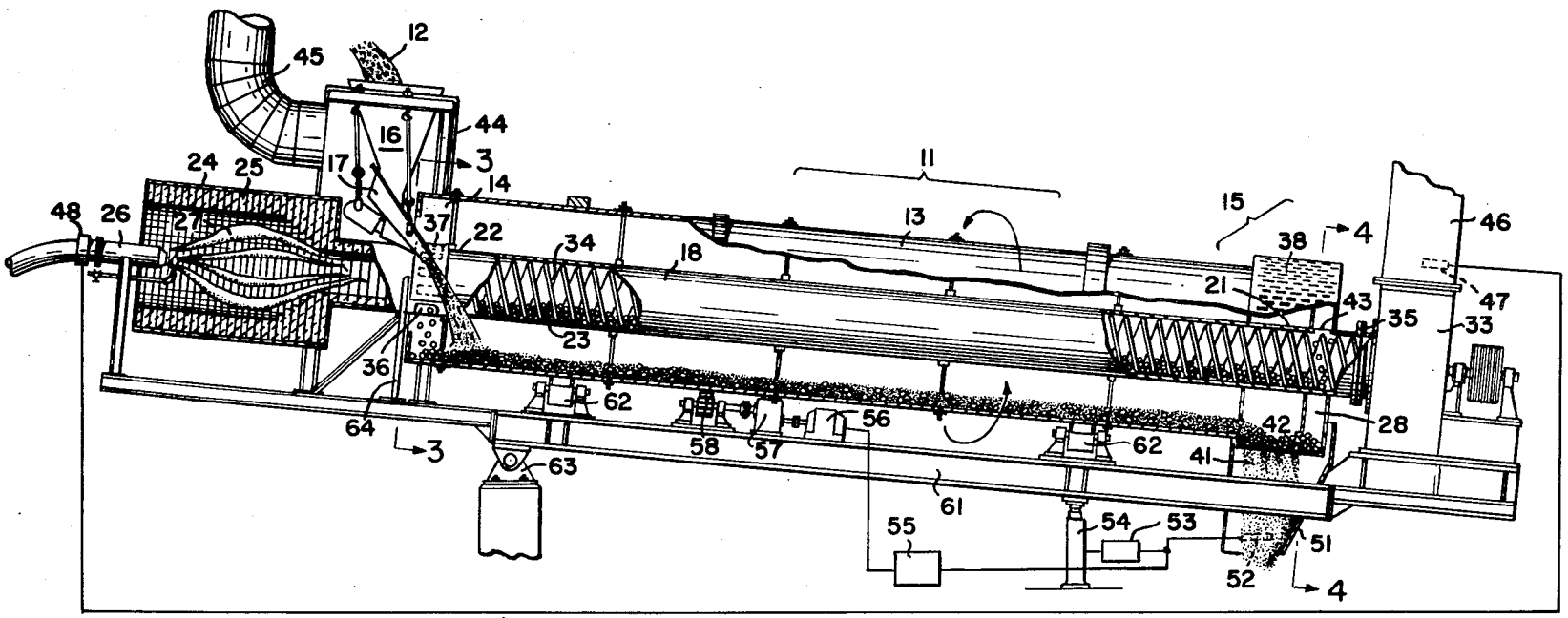
FIG. 2 is an elevational view, partly in section and partly schematic, of the dryer shown in FIG. 1.

FIG. 6 shows, a somewhat schematically, a modification of air lock 32 in FIG. 4. The modified air locks comprising pivoted gates **32*a* and 32*b*, each held closed by a spring 66 and opened by the action of an arm 67 operating over a cam 68 which may also be used. Each lifting chamber 28 passage contains two such gates. Their operating cams are arranged in such a way that one or the other is closed at all times. The heated particles (now cool) pass through the outer gate 32*a* as it is opened, while the inner gate 32*b* is kept closed by its spring 66. Further rotation allows the first gate to close behind the heated particles (now cool) which have passed through it. The inner gate 32*b* now opens, passing the heated particles into housing 18**. The cams are so arranged that a single set of two actuates the pivoted gates in however many passages there may be in the lifting chamber.

An exhaust fan 33 positioned downstream of lifting chamber 28 pulls the hot gases from firing chamber 24 through housing 18. Air locks 32 prevent excess air from lifting chamber 28 from reducing the efficiency of the exhaust fan.

In the embodiment of the invention of FIGS. 1–4, housing 18 is positioned concentrically within cylinder 13 and rotates therewith. A screw conveyor 34 is mounted within housing 18 for advancing particles 23 from feed end 21 to discharge end 22, and the flights of screw conveyor 34 are perforated near their outer periphery so that the hot gases 27 pass through the particles as they advance along the bottom of housing 18.

A fan protection screen 35 is located at the bottom end of housing 18 and acts as a guard to prevent particles 23 from passing into fan 33.

The discharge end 22 of housing 18 has discharge slots 36 formed therein through which the heated particles are fed into cylinder 13. A cover 37 is positioned around the top and sides of discharge end 22 and covers all but the downwardly-facing slots 36 during rotation of the housing so as to prevent wet granular material 12 from entering housing 18 through the slots.

At the discharge end 15 of cylinder 13, there is a screen section 38 through which the dried granular material 41 is discharged. Particles 23 are too large to pass through the slots in screen section 38, and pass into lifting chamber 28 over an annular ring which forms a dam 42. Dam 42 is high enough that particles 23 pass into chamber 28 free of the granular material which passes through screen 38. Lifters 31 elevate particles 23 to the height of the feed end 21 of housing 18 and drop them through air locks 32 and into housing 18 through feed opening 43.

During operation of the dryer, water vapor is liberated at feed end 14 from the wet granular material 12 by contact with the heated particles 23, and this vapor is disposed of by passing it through a water vapor hood 44 and a discharge duct 45 which may connect with a stack, or may connect directly to atmosphere. A fan may be positioned in duct 45 to assist in pulling the vapor from cylinder 13.

The hot gases 27 lose heat during their passage through housing 18 and are discharged through a discharge duct 46 located at feed end 21. A temperature sensor 47 is positioned in duct 46 and measures the temperature of the cooled gases. Sensor 47 is connected to and actuates a fuel control valve 48 which controls the amount of fuel being fed to the burner 26, thereby controlling the temperature of particles 23.

The dried granular material is discharged at end 15 into a chute 51. A moisture sensor 52 is positioned in chute 51 to measure the moisture content of the dried material, and is connected to a lifting mechanism control 53 that adjusts the height of lifting mechanism 54 which supports one end of the dryer. Sensor 52 signals control 53 to raise lifting mechanism 54. Accordingly, the slope is decreased and the granular material remains in the cylinder longer and more water is evaporated from the material.

If the granular material is too dry, moisture sensor 52 signals control 53 to lower lifting mechanism 54. Accordingly, the slope is increased and the material runs through faster so that less moisture is evaporated.

In addition to being connected to lifting mechanism control 53, or as an alternative to this connection, moisture sensor 52 may be connected to a motor speed control 55 that adjusts the speed of a motor 56 which rotates cylinder 13 through a variable speed reducer 57 and gears 58.

If moisture sensor 52 ascertains that the moisture content of granular material 41 is too high, it signals motor speed control 55 to decrease the rotational speed of motor 56 and cylinder 13 to slow the travel of the material through the cylinder and thereby increase the retention time of the material in cylinder 13 so that more water is evaporated. If moisture sensor 52 ascertains that the moisture content is too low, it signals motor speed control 55 to increase the rotational speed of motor 56 and cylinder 13 to quicken the travel of the mixture through the cylinder and thereby decrease retention time so that less water is evaporated.

In the present invention wherein all the moisture may be removed and the dustiness controlled solely by the addition of a suitable oil-like material, dryer 11 may be controlled by a much simpler and more inexpensive as well as a more reliable temperature sensor.

A main frame 61 supports the elements of the dryer, including firing chamber 24, water vapor hood 44, exhaust fan 33, motor 56, gears 58, and cylinder roller assemblies 62. Main frame 61 is supported at the feed end of the dryer by a pivot assembly 63 and at the discharge end by lifting mechanism 54.

In operation, wet granular material 12 is introduced either alone or together with the introduction of petroleum derivative into feed hopper 16 and is deflected by vibrating feed chutes 17 into the feed end 14 of cylinder 13 which is being rotated by drive motor 56 through variable speed reducer 57 and cylinder drive gears 58, the cylinder being supported for rotation on cylinder roller assemblies 62.

If the petroleum or coal derivative is not fed with the wet granular material, it can be introduced at any point along the length of the dryer cylinder 13.

Cover 37 is supported on main frame 61 by legs 64 that hold the cover stationary and prevent any particles of the wet granulated material 12 from entering housing 18 through discharge slots 36.

Hot gases 27 produced in firing chamber 24 by burner 26 are drawn through screw conveyor housing 18 by fan 33, and pass over, around and through the particles 23 to heat them to the desired high temperature. The gases 27 are cooled by this passage through housing 18 and transfer of heat to particles 23, and are discharged to the atmosphere by exhaust fan 33 through a discharge duct 46.

The hot particles 23 are discharged by gravity from discharge end 22 of housing 18 into feed end 14 of cylinder 13 through slots 36. The hot particles 23 mix with wet granular material 12 and transfer heat thereto as the mixture moves down the slope of rotating cylinder 13. The heat converts the water in the wet granular material into water vaor which is discharged through discharge duct 45. The dried mixture falls into the enlarged diameter discharge end 15 and is separated into its components of particles 23 and the now dried granular material 41. The dried granular material 41 passes through the openings in the screen section 38 into discharge chute 51, and the particles 23 flow over dam 42 into lifting chamber 28.

Lifters 31 elevate the particles so that they fall through air locks 32 and feed openings 43 into housing 18. Screw conveyor 34 moves the particles up the slope of housing 18 as they are being heated by the hot gases 27 and then feeds them through discharge slots 36 into feed end 14 of rotating cylinder 13.

The water vapor which is liberated from the wet granular material 12 when it is contacted by and mixed with hot particles 23 is withdrawn from rotating cylinder 13 through water vapor hood 44 and discharge duct 45.

Figure 5:
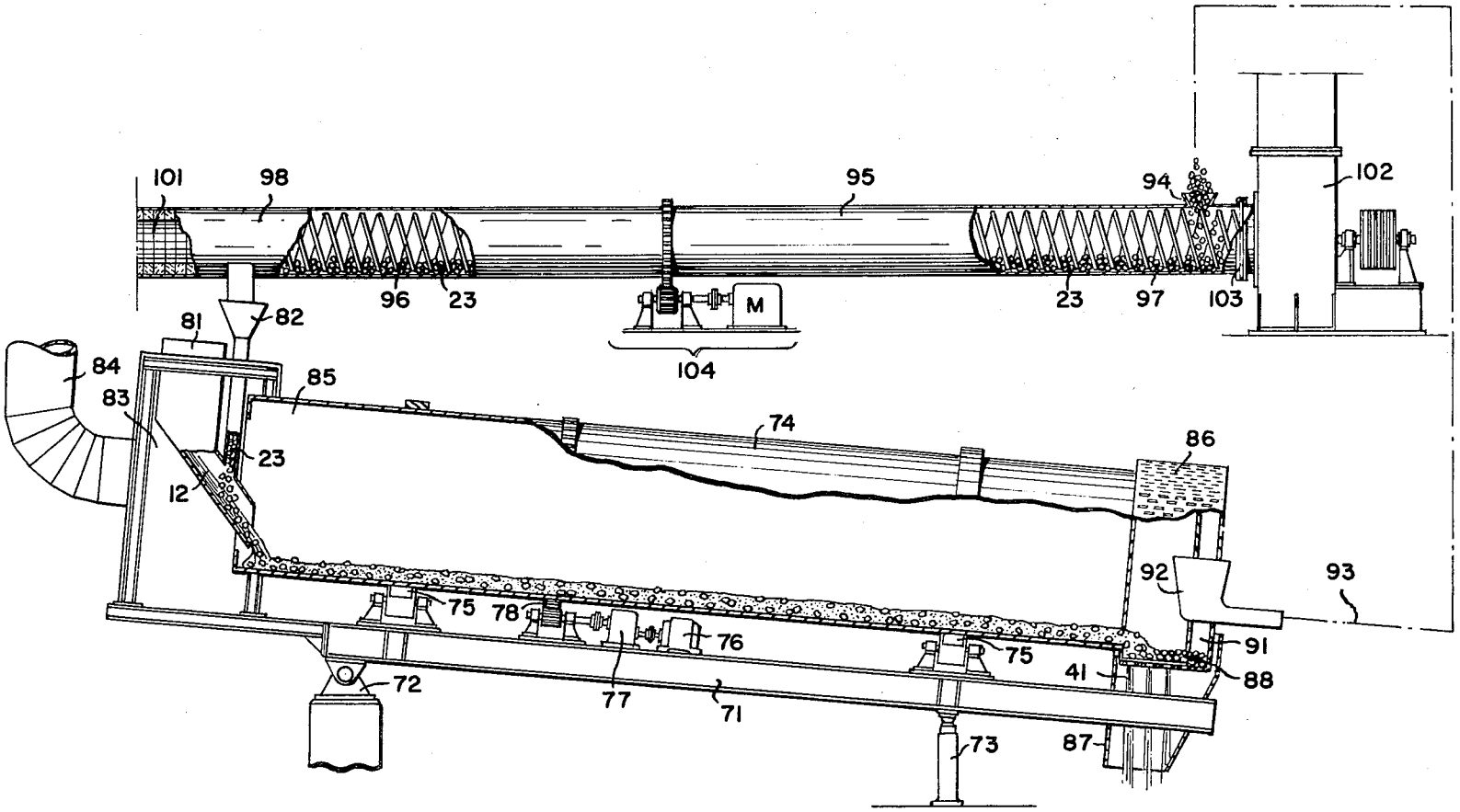
FIG. 5 is an elevational view, partly in section and partly schematic, of another embodiment of the invention; and, FIG. 6 shows a modification of FIG. 4 showing a pair of cam-operated pivoted gates and embodying the principles of the present invention.

FIG. 5 illustrates another embodiment of the invention wherein the housing for heating the particles is placed outside the rotatable cylinder. As is shown, this form of dryer includes a main frame 71 supported by pivot assembly 72 and lifting mechanism 73.

A rotatable cylinder 74 is supported on main frame 71 by roller assemblies 75 and is rotated by motor 76 through variable speed reducer 77 and drive gears 78.

Wet granular material 12 is introduced into rotatable cylinder 74 through a feed hopper 81, and hot particles 23 are introduced into cylinder 74 through a hopper 82. Water vapor created by the mixing of the particles 23 and wet granular material 12 is discharged from the dryer through water vapor hood 83 and discharge duct 84.

The mixture of granular material and particles 23 passes through cylinder 74 from feed end 85 to screened discharge end 86 where the now dried granular material 41 passes downwardly through the screen slots into a discharge chute 87, while the particles 23 ride over dam 88 into lifting chamber 91 where they are elevated by lifters 31 and discharged through air locks 32 into a receiving hopper 92. The now cooled particles 23 are transferred from hopper 92 by any suitable mechanism, such as by conveyor 93, to a feed hopper 94 of a housing 95 which includes a screw conveyor 96 that transports the particles from feed end 97 of housing 95 to discharge end 98.

During the passage of particles 23 through housing 95, they are heated by hot gases generated in firing chamber 101. The hot gases are sucked through housing 95 by a fan 102 which is protected from particles 23 by a screen 103.

Since housing 95 is external to drum or cylinder 74, it is rotated by a separate drive mechanism 104.

Thus it will be seen that I have provided a novel method for drying wet granular coal and while so doing, uniformly distributing a liquid petroleum derivative throughout the granules or particles, whereby the end product will be dry, granular coal having a coating of oil-like petroleum derivative which will greatly increase the B.T.U. or heat value of the coal and which will eliminate the problem of dustiness and the attendant environmental disadvantages thereof, as well as the dangerous features of such dustiness; also I have provided coal particles having maximum heat value per unit of volume or weight so as to greatly economize in cost, storage space and freight costs, also I have provided an improved dryer providing a double pivoted gate arrangement to allow passage of the particles without passage of air.

While the present method and improved drying apparatus have been described in connection with coal particles, it will be apparent that the method and apparatus may be applied to any other material in granular form where it is desired to dry the material and coat it with an oil-like or other material for any other purpose such as a preservative coating, or a binder for briquetting the coal, such as lignin sulfonate, coal tar or a saturated brine solution.

I claim:

1. The method of treating wet coal granules, comprising passing said wet coal granules through a dryer in the form of a heated cylindrical drum rotated about its axis while heated steel balls are moved through said wet granules and introducing a liquid petroleum derivative, which is essentially non-volatile at the boiling point of water, into said dryer so as to effect simultaneous drying of the coal granules and uniform coating of their surfaces with said liquid petroleum derivative so as to obtain a relatively dry, oil-like coating on said granules which is dust free.

2. The method of treating coal granules, as recited in claim 1, wherein said liquid petroleum derivative is introduced into said dryer together with said wet coal granules.

3. The method recited in claim 1 wherein said liquid petroleum derivative is introduced into said dryer after partial drying of said wet coal granules.

4. The method recited in claim 1 wherein a binder for enabling briquetting of the coal granules is also introduced into said wet coal granules in said dryer.

5. The method recited in claim 4 wherein said binder is lignin sulfonate.

6. The method recited in claim 4 wherein said binder is a saturated brine solution.

* * * * *